US006782577B2

(12) United States Patent
Rieber et al.

(10) Patent No.: US 6,782,577 B2
(45) Date of Patent: Aug. 31, 2004

(54) KNOCK-DOWN QUARTER PIPE FOR SKATEBOARDERS, BIKERS AND IN-LINE SKATERS

(75) Inventors: Frederick M. Rieber, Alum Bank, PA (US); Don McCloskey, Everett, PA (US); Frank Bork, Bedford, PA (US)

(73) Assignee: Hedstrom Corporation, Bedford, PA (US)

( * ) Notice: Subject to any disclaimer, the term of this patent is extended or adjusted under 35 U.S.C. 154(b) by 44 days.

(21) Appl. No.: 10/282,848

(22) Filed: Oct. 29, 2002

(65) Prior Publication Data

US 2004/0078907 A1 Apr. 29, 2004

(51) Int. Cl.[7] ..... E01D 4/00
(52) U.S. Cl. ..... 14/71.1; 472/89
(58) Field of Search ..... 14/69.5, 71.1; 404/1; 472/88–91

(56) References Cited

U.S. PATENT DOCUMENTS

| | | | | |
|---|---|---|---|---|
| D246,638 | S | | 12/1977 | Hegedus |
| 4,129,916 | A | | 12/1978 | Schlesinger et al. |
| D257,874 | S | | 1/1981 | Sheehan et al. |
| 4,697,294 | A | | 10/1987 | Schafer |
| 5,033,146 | A | | 7/1991 | Fogarty et al. |
| 5,267,367 | A | | 12/1993 | Wegmann, Jr. |
| 5,341,533 | A | | 8/1994 | Seitz |
| 5,483,715 | A | | 1/1996 | Fogarty et al. |
| 5,524,310 | A | | 6/1996 | Farnen |
| 5,599,235 | A | | 2/1997 | Lynberg |
| D390,621 | S | | 2/1998 | Cosentino |
| 5,718,412 | A | | 2/1998 | Levanas |
| 5,870,788 | A | | 2/1999 | Witkin |
| 5,946,756 | A | | 9/1999 | Mapp |
| 6,042,480 | A | * | 3/2000 | Labelson ..... 472/89 |
| 6,336,771 | B1 | * | 1/2002 | Hill ..... 405/79 |
| 6,350,174 | B1 | * | 2/2002 | Halford et al. ..... 446/444 |
| 6,623,367 | B1 | * | 9/2003 | Labelson et al. ..... 472/89 |
| 6,672,968 | B2 | * | 1/2004 | Montolio ..... 472/89 |
| 6,676,529 | B2 | * | 1/2004 | Pernal ..... 472/89 |
| 2002/0183124 | A1 | * | 12/2002 | Isabelle et al. ..... 472/89 |
| 2003/0027644 | A1 | | 2/2003 | Soderberg |
| 2003/0125120 | A1 | | 7/2003 | Montolio |

FOREIGN PATENT DOCUMENTS

| | | | |
|---|---|---|---|
| DE | 197 17 491 | C | 10/1998 |
| EP | 0870523 | A2 | 10/1998 |
| FR | 2 702 965 | A | 9/1994 |
| FR | 2 757 075 | A1 | 6/1998 |
| WO | WO 00/51694 | A1 | 9/2000 |

* cited by examiner

*Primary Examiner*—Robert E. Pezzuto
*Assistant Examiner*—Alexandra K. Pechhold
(74) *Attorney, Agent, or Firm*—Cesari and McKenna, LLP

(57) ABSTRACT

A knock-down quarter pipe for bikers, skateboarders and in-line skaters has a base, and a plurality of legs extending up from the base, the legs having lower ends lying in a common plane. A deck is supported by the legs at a selected elevation above the base, the deck having front and rear edges and a surface extending between those edges that is substantially parallel to the plane. A ramp extends from the front edge of the deck down to the plane, that ramp having a lower leading edge that is located in that plane and spaced in front of a base. Preferably, the base and at least the lower end portion of the ramp may be filed with a fluid medium to add weight to and lower the center of gravity of the quarter pipe. Preferably also, a rigid coping rail is located between the front edge of the deck and the ramp which can function as a grind rail.

37 Claims, 4 Drawing Sheets

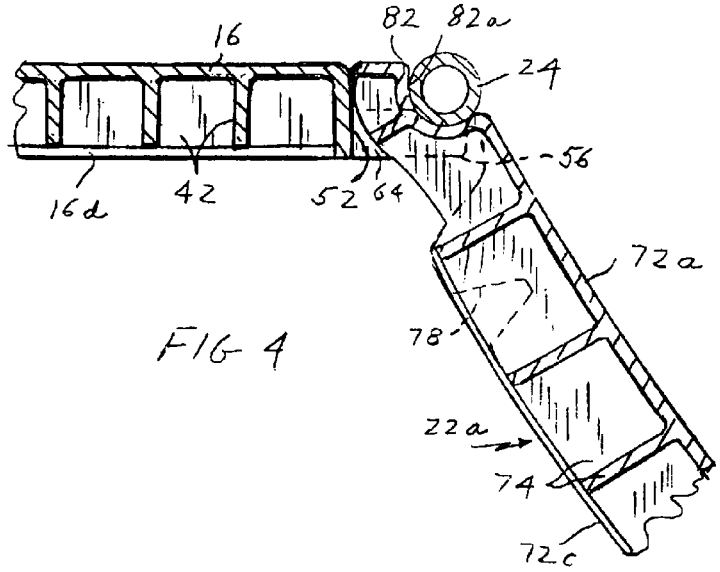
FIG 4
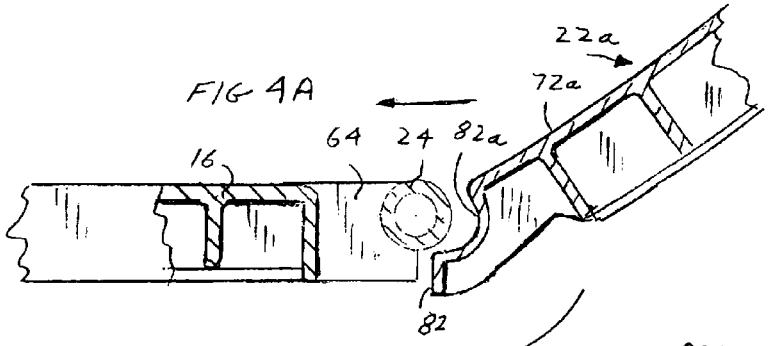
FIG 4A
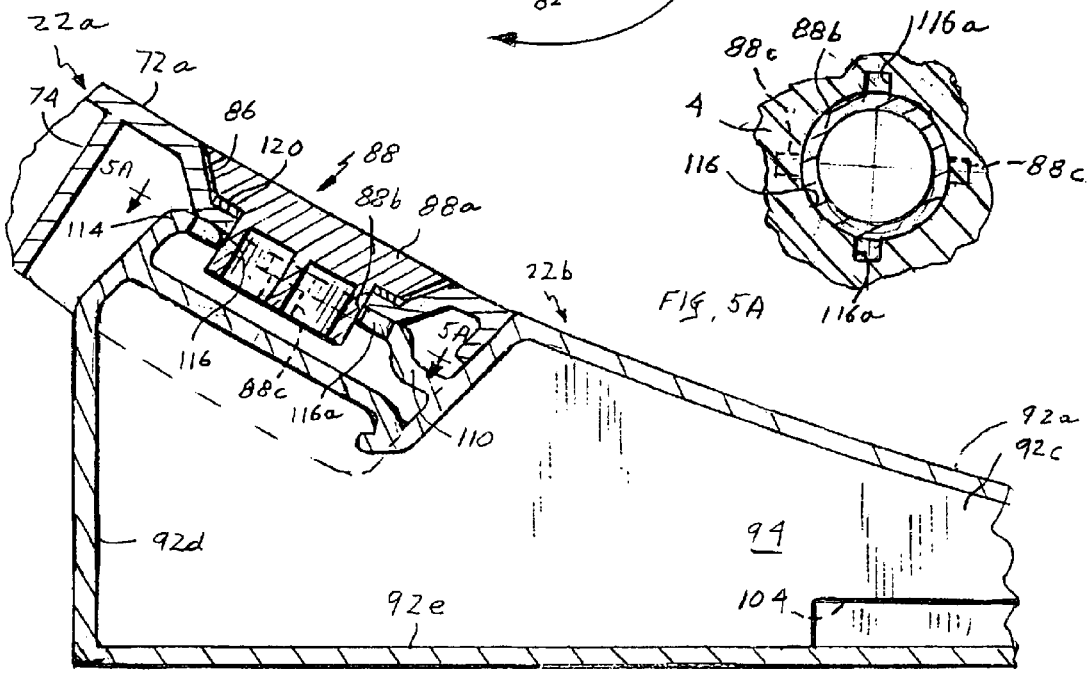
FIG. 5A
FIG 5

KNOCK-DOWN QUARTER PIPE FOR SKATEBOARDERS, BIKERS AND IN-LINE SKATERS

RELATED APPLICATIONS

Not Applicable

BACKGROUND OF THE INVENTION

This invention relates to obstacles used by skateboarders, bikers and in-line skaters to enhance their individual ability and enjoyment. It relates more particularly to an obstacle referred to as a quarter pipe.

FIELD OF THE INVENTION

A quarter pipe, as the name suggests, is an obstruction which has a shape corresponding to one quadrant of a cylinder with an entry edge of the cylinder being located next to the ground. The quarter pipe thus constitutes a ramp which redirects a rider entering the ramp upward approximately 90° to a platform, cornice or rail which allows the rider to reverse direction and roll down the quarter pipe to ground level.

Usually such quarter pipes are relatively massive unitary obstacles made of reinforced concrete or the like and because of their cost, they are usually only found in parks and other public spaces. They are not designed for home use.

SUMMARY OF THE INVENTION

It is an object of the present invention to provide a quarter pipe which can be sold in a knock-down condition and assembled by the average purchaser for home use.

Another object of the invention is to provide such a quarter pipe which is easy to assemble and, when assembled, is rugged enough to withstand prolonged use by skateboarders, bikers and in-line skaters.

A further object of the invention is to provide a quarter pipe which, although portable, is quite stable in use.

Yet another object of the invention is to provide a knock-down quarter pipe composed of a minimum number of parts which can be assembled in a minimum amount of time without requiring any tools.

Other objects of the invention will, in part, be obvious and will, in part, appear hereinafter.

The invention accordingly comprises the features of construction, combination of elements and arrangement of parts which will be exemplified in the following detailed description and the scope of the invention will be indicated in the claims.

Briefly, our quarter pipe comprises a base supported by a plurality of legs which extend up to a raised platform or deck. A curved ramp extends from an edge of the deck down to the ground in front of the base, the ramp being composed of a wedge-like entry section adjacent to the ground and one or more concavely curved ramp sections which extend from the entry section up to the deck. Preferably, the upper end of the ramp sections transition to the deck by way of a coping rail which may function as a grind rail for skateboarders and skaters using the quarter pipe. Preferably also, a handrail extends up from the rear edge of the deck opposite the ramp sections as a safety precaution. Also, in a preferred embodiment of the invention, the aforesaid base and entry sections are designed to be filled with a relatively heavy fluid medium such as water or sand in order to increase the weight of the apparatus and lower its center of gravity. This helps to stabilize the quarter pipe and prevent it from moving around when in use.

As we shall see, the quarter pipe is composed of a minimum number of parts which are relatively inexpensive to make in quantity and which can be assembled very easily using only a screwdriver when the unit is first set up and no tools thereafter. Therefor, it can be sold in a knock-down condition for assembly by the purchaser. Furthermore, when not in use, it can be disassembled without any tools and stored in a minimum amount of space. Therefor it should prove to be a popular and marketable toy product.

BRIEF DESCRIPTION OF THE DRAWINGS

For a fuller understanding of the nature and objects of the invention, reference should be made to the following detailed description taken in connection with the accompanying drawings, in which:

FIG. 4 is a sectional view taken along line 4—4 of FIG. 1;

FIG. 4A is a similar view showing the same parts disassembled;

FIG. 5 is a sectional view, on a larger scale, taken along line 5—5 of FIG. 1, and FIG. 5A is a sectional view taken along line 5A—5A of FIG. 5.

DETAILED DESCRIPTION OF THE PREFERRED EMBODIMENT

Figure 1:
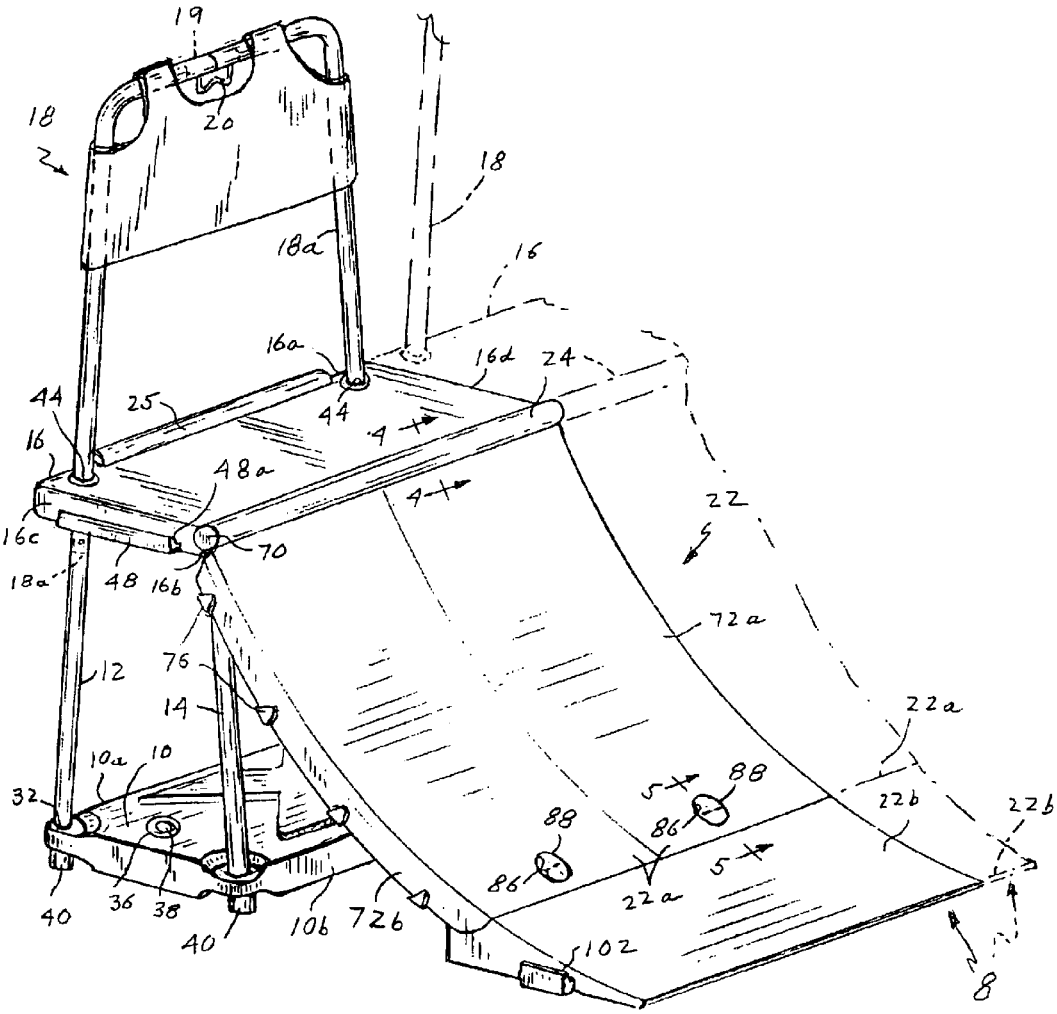
FIG. 1 is a right front perspective view of a quarter pipe incorporating invention.
Figure 2:
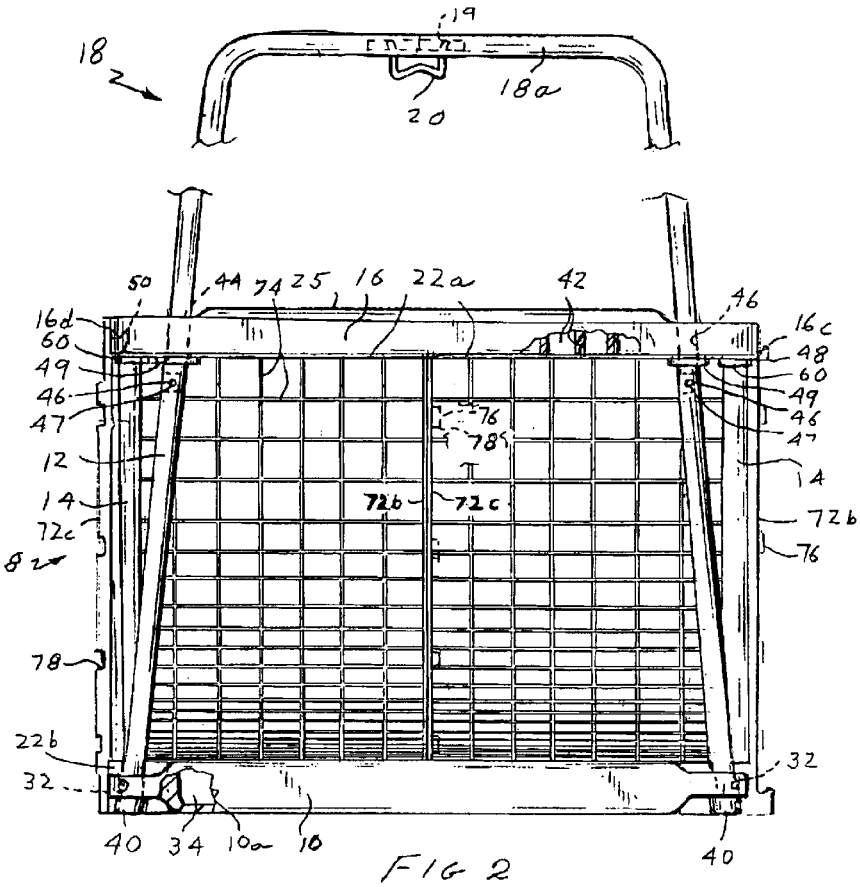
FIG. 2 is a rear elevational view thereof.

Referring to FIGS. 1 and 2 of the drawings, our quarter pipe, shown generally at 8, comprises a generally rectangular base 10 in the form of a water tank having a rear wall 10*a* and a front wall 10*b*. The base is supported at its corners by a pair of tubular rear legs 12 and a pair of tubular front legs 14. Those legs extend up to a generally rectangular raised deck or platform 16 which is spaced appreciably above base 10 and has a rear wall 16*a*, a front wall 16*b* and opposite end walls 16*c* and 16*d*. As best seen in FIG. 2, the front legs 14 are more or less vertical, while the rear legs 12 are toed in so that they may be slightly longer than legs 14 in order to maintain deck 16 in a horizontal plane.

As shown in FIG. 1, an inverted, generally U-shaped tubular handrail 18 extends up from deck 16 adjacent the rear wall 16*a* thereof. Preferably, the legs of the handrail 18 are aligned with rear legs 12. Preferably also, the handrail is composed of two mirror-image L-shaped sections 18*a*, 18*a* connected at their upper ends by a short tube 19 telescoped into the opposing ends of the two sections. The sections may be clamped together around the tube 19 by a clip 20 of the type described in application Ser. No. 09/991,811, the contents of which are hereby incorporated by reference herein.

Still referring to FIGS. 1 and 2, deck 16 supports at its front edge 16*b* the upper end of a ramp shown generally at 22. The ramp has concave curvature so that its lower end rests on the ground well in front of base 10. As best seen in FIG. 1, ramp 22 is preferably composed of at least two identical arcuate ramp sections 22*a*, 22*a* arranged side by side, and a generally wedge-shaped entry section 22*b* which supports the lower ends of sections 22*a* and extends down to the ground so that the totality forms a concavely curved ramp surface which presents a sharp leading edge at ground level.

Preferably also, the transition of the upper end of ramp 22 to deck 16 is provided by means of a generally horizontal, rigid, tubular coping rail 24 which extends the full width of ramp 22 and may be function as a grind rail. The diameter of the coping rail is such that the opposing ends of the deck and ramp upper surfaces are tangent to the coping rail. This enables a skateboarder, for example, while rolling up ramp 22 to deck 16 to pause on, or roll along, rail 24 in order to reverse direction and roll down ramp 22 to the ground. On the other hand, a rider riding up ramp 22 may roll over the coping rail 22 onto deck 16 in order to rest or execute a reversal on the deck. The handrail 18 is provided to assist in that respect and for safety reasons. Also to prevent over-travel of skate wheels, a raised rib 25 may be provided adjacent the rear wall 16*a* of the deck, the rib extending at least between the legs of handrail 18.

As we shall see, the components of the quarter pipe are dimensioned and spaced so that when assembled, the apparatus is quite stable while in use. To add to this stability, the base 10 and entry section 22*b* are preferably weighted to increase the overall mass of the apparatus and to lower its center of gravity. This assures that when a rider rolls up ramp 22 to deck 16, the weight and momentum of the rider will not cause the apparatus to tip over, tilt or shift relative to the ground.

As shown in FIGS. 1 and 2, the illustrated base 10 is generally rectangular and molded of a suitable strong, weather-resistant plastic such as polyethylene. Typically its dimensions are 4 ft. by 2 ft. by 4 in. Preferably, the base is solid or rigidified at the corners so that through holes 32 may be provided to accommodate the legs 12 and 14. However, the remainder of the base 10 is preferably hollow to provide a fluid tight cavity 34 which may be filled with a fluid such as water or sand in order to increase the weight of the base. As best seen in FIG. 2, one or more holes 36 may be provided in the top wall 10*a* of base 10 adjacent to the center line thereof to fill up, and drain the fluid from, cavity 34. When the base is filled with fluid, these holes may be closed by suitable plugs 38.

When assembling legs 12 and 14 to base 10, the lower ends of the legs are inserted through the corner holes 32 in the base and end caps 40 are secured to the lower ends of the legs so that the corners of the base are supported by the end caps when the end caps rest on the ground or other support surface. Alternatively, the base 10 itself may rest on the ground.

Figure 3:
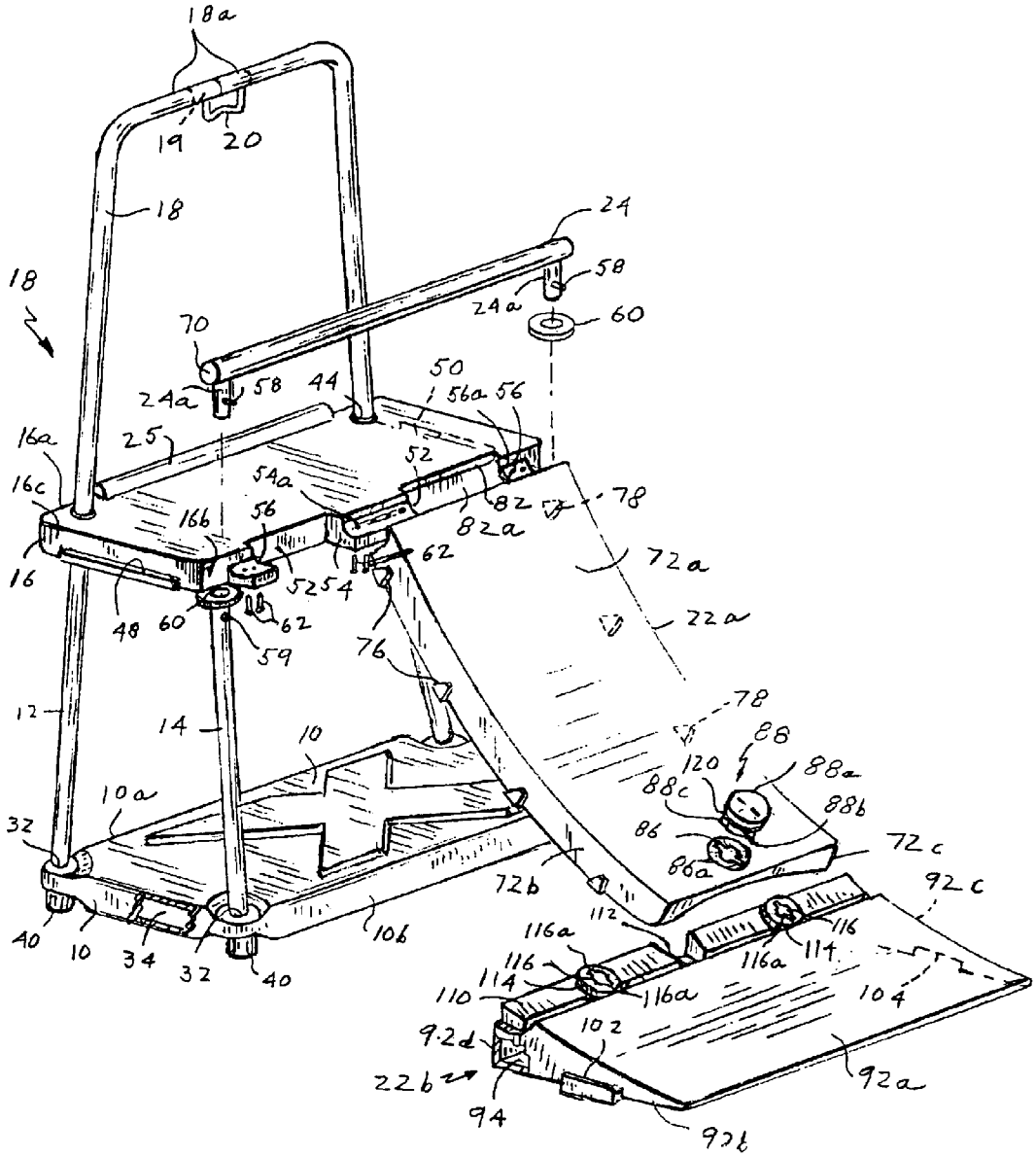
FIG. 3 is an exploded perspective view, with parts broken away, showing the components of the FIG. 1 quarter pipe in greater detail.

Referring to FIGS. 1 to 3, deck 16 is also a generally rectangular molded plastic article having dimensions slightly smaller than those of base 10. Typically, the deck 16 is spaced about 3 feet above the ground. However unlike base 10, deck 16 is not hollow. Rather it has an open bottom and a multiplicity of intersecting ribs 42 extend down from the top wall of the deck between the side and end walls thereof to form a grid structure which makes the deck quite resistant to bending and racking forces.

As best seen in FIG. 2, a pair of vertical through holes 44 are provided in deck 16 adjacent to the rear corners thereof directly above the upper ends of rear legs 12. These holes are smaller than the leg 12 outside diameter but are large enough to slidebly receive the lower ends of the hand rail sections 18*a* which are sized to telescope into the upper ends of legs 12 as shown. The hand rail sections 18*a* may be releasably retained in legs 12 by conventional spring-loaded push buttons 46 mounted in the legs of sections 18*a* and which snap into holes 47 formed in legs 12. The deck 16 is supported by rigid washers 49 which sit on the upper ends of legs 12 as shown in FIG. 2, the openings in the washers being sized to slidebly receive the legs of the rail sections 18*a*.

The attachment of the front legs 14 to deck 16 is somewhat different as will be described shortly. Also for reasons that will become apparent, deck 16 is provided at one side with a long key or a lug 48 which projects out laterally from the deck and has an upwardly extending nose 48*a*. In addition, an elongated keyhole or notch 50 is provided at the opposite end of deck 16 which is adapted to receive the key 48 of an adjacent deck 16. This allows the FIG. 1 quarter pipe 8 to be keyed to one or more adjacent similar quarter pipes 8 arranged side by side as shown in phantom in FIG. 1.

Referring to FIG. 3, the front edge 16*b* of deck 16 is formed with a pair of aligned notches 52 spaced apart along that edge and separated by a relatively long shelf 54 which projects out from deck wall 16*b*. The shelf 54 has an upper surface 54*a* which is generally semi-cylindrical with the same curvature as that of coping rail 24. In addition, a pair of side shelves 56 project out from deck wall 16*b* adjacent to the outboard ends of the notches 52. Shelves 56 are set in from the opposite ends of wall 16*b* enough to provide clearance of the upper ends of the front legs 14. Like shelf 54, shelves 56 have semi-cylindrical upper surfaces 56*a* which are co-linear with surface 54*a*.

As shown in FIG. 3, the coping rail 24 is provided with a pair of downwardly extending tubular stubs 24*a* which are sized and spaced apart to telescope into the upper ends of legs 14 when the coping rail is seated on shelves 54 and 56. When so seated, the legs 14 may be releasably secured to the coping rail 24 by spring-loaded push buttons 58 projecting from rail stubs 24*a* and which are adapted to snap into holes 59 in legs 14. The washers 60 which sit on the upper end of legs 14 support the front corners of deck 16 in the same manner of the washers 49 over rear legs 12.

Preferably, as part of the initial set up of the quarter pipe, the coping rail 24 is permanently attached to shelves 54, 56 by suitable threaded fasteners 62 (FIG. 3) inserted from below the shelves and threaded into the rail. This leaves openings 64 between the rail and the rear walls of notches 52 as shown in FIGS. 4 and 4A. Preferably also, the open ends of rail 24 are closed by suitable end plugs 70.

Referring to FIGS. 2 and 3, each ramp section 22*a* has a curved top wall 72*a* and a pair of opposite side walls 72*b* and 72*c* which extend down from wall 72*a*. As best seen in FIG. 2, a multiplicity of ribs 74 extend down from the underside of wall 72*a* and form a rectangular grid between the side walls 72*b* and 72*c*. Typically, each section is a molded article of the same material as base 10 and is about 4 ft. long and 2 ft. wide. A series of wedge-shaped keys 76 project out from the side wall 72*b* of each ramp section 22*a*. These keys are adapted to key into a corresponding series of wedge-shaped keyholes 78 in each ramp section wall 72*c* to prevent movement of the two sections away from one another, i.e. in a horizontal manner.

Figure 6:
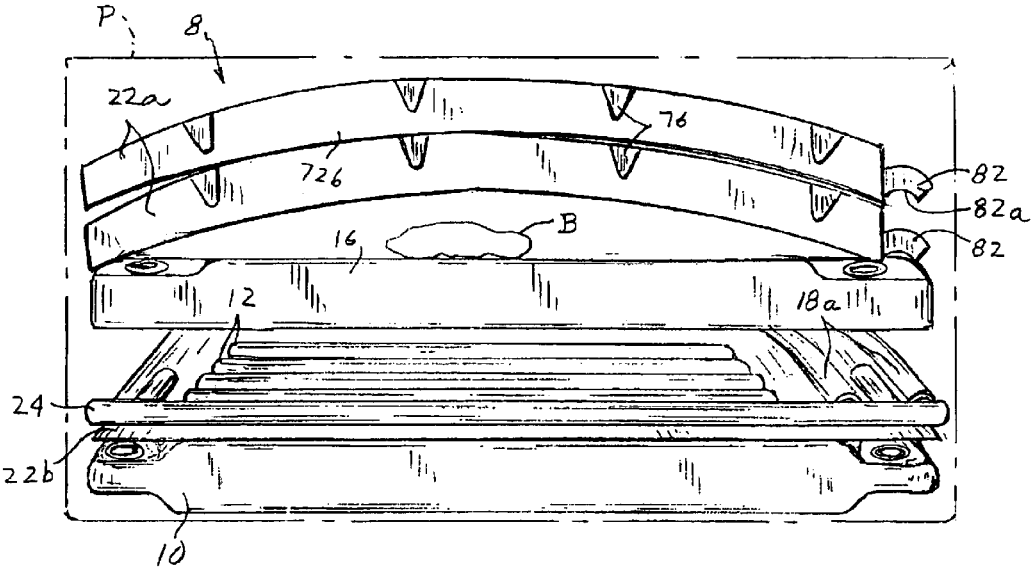
FIG. 6 is an elevational view showing the components of FIG. 1 quarter pipe stacked in a package.

Referring to FIGS. 3, 4 and 6, a curved tongue 82 projects from the upper end of each ramp section 22*a*. The tongue 82 is set in from the opposite sides of the ramp section and its length is slightly less than the length of the notches 52 in deck 16. The upper surface 82*a* of tongue 82 has essentially the same curvature as the shelf surfaces 54*a*, 56*a*. Thus after the coping rail 24 has been permanently anchored to deck 16 as described above, the ramp sections 22*a* may be attached to the deck by inserting the tongues 82 of the ramp sections into the openings 64 behind rail 24 from below as shown in FIG. 4 and rotating the sections clockwise in that figure so that the tongue surfaces engage under and behind rail 24 as shown in FIG. 4. Thus when the ramp sections 22*a* are in their downwardly sloping positions shown in FIG. 4, the tongues 82 of those sections are securely locked to deck 16. However, those connections still allow the sections to pivot about the rail to some extent so that the legs 12, 14, on the one hand, and ramp entry section 22*b*, on the other, can rest stably on somewhat uneven ground. In other words, the connections allow automatic leveling of the quarter pipe on uneven ground. The connections also allow the ramp sections to be detached from the deck 16 simply by swinging the sections 22 up to the position shown in FIG. 4A and withdrawing the tongues 82 from openings 64; no tools are required for such detachment or subsequent reassembly.

As shown in FIGS. 1 and 3, in order to secure the lower end of each ramp section 22*a* to entry section 22*b*, the top wall 72*a* of each ramp section is formed with a relatively large counter sunk hole 86 having diametrically opposite, laterally extending notches 86*a* in the edge of the hole. As will be described shortly, the hole 86 is adapted to receive a locking cap 88 which locks the lower end of each ramp section 22*a* to the entry section 22*b*.

Referring now to FIGS. 3 and 5, entry section 22*b* is preferably made of the same material as base 10 and deck 16 and has more or less the same length and width dimensions as deck 16. The entry section has a gently concavely curved top wall 92*a*, a pair of opposite wedge-shaped sidewalls 92*b* and 92*c*, a rear wall 92*d* and a bottom wall 92*e* which together define an internal fluid-tight cavity 94. As best seen in FIG. 1, the entry section 22*b* provides a sharp leading edge transition from entry section 22 to the ground or other support surface.

An elongated key or lug 102 projects laterally from side wall 92*b* adjacent to the bottom of the entry section. Also, a key hole 104 is provided in the opposite side wall 92*c* of entry section 22*b* which key hole is arranged and adapted to receive the key 102 of an adjacent quarter pipe 8 so that two or more of the FIG. 1 quarter pipes 8 can be placed side by side and locked together. In other words the key holes 50, 78 and 104 of the quarter pipe 8 depicted in FIG. 1 are adapted to receive the keys 48, 76 and 102 of the similar quarter pipe shown in phantom in FIG. 1. Thus, a series of quarter pipes may be locked together to form an elongated version of the quarter pipe shown in solid lines in FIG. 1.

Referring to FIGS. 3 and 5, the upper rear edge segment of entry section 22*b* is formed with a pair of laterally spaced apart shelves 110 recessed or stepped down from the upper end of top wall 92*a*, the shelves being separated by a vertical notch 112. Each shelf 110 has an inclined top wall with a discoid promontory 114 centered in the shelf. Furthermore, each promontory is formed with a relatively large locking hole 116 centered in the promontory and which opens into cavity 94. A pair of diametrically opposite notches or keyholes 116*a* are present at the edge of hole 116, the notches being aligned with the short axis of the entry section.

The entry section 22*b* is designed so that when the lower end segments of the ramp sections 22*a* are seated side by side on shelves 110, the opposing, keyed-together side walls 72*b* and 72*c* of the two ramp sections 22*a* extend down into the notch 112 in entry section 22*b* and the holes 86 and notches 81*a* of the two ramp sections are aligned with the holes 116 and notches 116*a* in the entry section promontories 114. This allows each locking cap 88 to be inserted down through the corresponding aligned holes 86 and 116. As best seen in FIG. 5, each cap 88 includes a head 88*a*, and a depending neck 88*b* having at its free end a pair of diametrically opposite keys or ears 88*c* which are sized to be received in the notches 86*a* and 116*a* when the ears are aligned with the notches. Then by pressing down and turning the cap 88 about 90°, the cap 88 firmly locks each ramp section 22*a* to the entry section 22*b* as shown in FIGS. 1 and 5. Preferably, a pair of aligned slots 117 are provided in each cap head 88*a* so that the caps may be turned using coins inserted into the slots; that is, no tools are required.

Referring to FIG. 5, like base 10, entry section 22*b*, i.e. its cavity 94, may be filled with water, sand or the like by way of the locking holes 116. Preferably, gaskets or seal rings 120 are provided on looking caps 88 under their heads 88*a* so that holes 116 are sealed when the locking caps 88 are locked in place as shown in FIGS. 1 and 5.

Referring to FIG. 6, all of the above-described components of the FIG. 1 quarter pipe 8 may be stacked and shipped along with a bag B containing miscellaneous parts such as the end caps 40, fasteners 62, plugs 70, washers 49, 60, etc. in a relatively small volume package or carton P. A customer may purchase the quarter pipe in that knock-down condition and assemble it in a minimum amount of time, attaching the various components of the quarter pipe in the manner described above. After assembling the quarter pipe, the user may fill the base 10 and the entry section 22*b* with a fluid to lower the unit's center of gravity and increase its mass so that the unit will not tilt or shift relative to the ground when skaters, skateboarders and the like ride up and down the quarter pipe 8. As noted above, a plurality of the quarter pipes 8 can be connected together side by side in order to increase the overall length of the obstacle so that the children using the obstacle can perform more intricate acrobatic feats.

It will thus be seen that the objects set forth above among those made apparent from the preceding description, are efficiently attained.

Also, since certain changes may be made in the above construction without departing from the scope of the invention, it is intended that all matter contained in the above description or shown in the accompanied drawings shall be interpreted as illustrative and not in a limiting sense.

It should also be understood that the following claims are intended to cover all of the generic and specific features of the invention described herein.

What is claimed is:

1. A knock-down quarter-pipe for bikers, skateboarders and in-line skaters comprising a base, said base including walls defining a fluid-type chamber, a first inlet in one or said walls for filling the chamber with a fluid medium and a first closure for said inlet;

a plurality of legs extending up from the base, said legs having lower ends lying in a common plane;

a deck supported by the legs at a selected elevation above the base, said deck having front and rear edges and a surface extending between said edges that is substantially parallel to said plane, and a ramp connected to the front edge of the deck and extending from said front edge down to said plane, said ramp having a lower leading edge that is located in said plane and spaced in front of said base.

2. The quarter pipe defined in claim 1 wherein said leading edge of the ramp is defined by a lower end segment of the ramp having walls that form a second fluid-tight chamber, and further including a second inlet in one of said walls and a second closure for the second inlet.

3. A The quarter pipe defined in claim 2 and further including first and second volumes of fluid medium in said first and second chambers.

4. A knock-down quarter-pipe for bikers, skateboards and in-line skaters comprising a base;

a plurality of less extending up from the base, said legs having lower ends lying in a common plane;

a deck supported by the legs at a selected elevation above the base, said deck having front and rear edges and a surface extending between said edges that are substantially parallel to said plane, and a ramp connected to the front edge of the deck and extending from said front edge down to said plane, said ramp having a lower leading edge that is located in said plane and spaced in front of the base, said ramp including an entry section having a lower end which defines said lower leading edge and an upper end which defines a shelf, said entry section being hollow and including an inlet for filling the entry section with a fluid medium, first and second ramp sections situated side by side and extending from the front edge of the deck down to said shelf, and first and second connectors for releasably connecting said first and second ramp sections to said shelf.

5. The quarter pipe defined in claim 4 and further including a closure member for said inlet.

6. The quarter pipe defined in claim 4 wherein the base is hollow and includes an inlet for filling the base with a fluid medium.

7. The quarter pipe defined in claim 6 and further including a closure member for said inlet.

8. A knock-down quarter-pipe for bikers, skateboarders and in-line skaters comprising a base;

a plurality of legs extending up from the base, said legs having lower ends lying in a common plane;

a deck supported by the legs at a selected elevation above the base, said deck having front and rear edges and a surface extending between said edges that are substantially parallel to said plane, and a ramp connected to the front edge of the deck and extending from said front edge down to said plane, said ramp having a lower leading edge that is located in said plane and spaced in front of the base, said ramp including a hollow entry section having a lower end which defines said lower leading edge and an upper end which defines a shelf and an inlet at said shelf, at least one arcuate ramp section which extends from the front edge of the deck down to said shelf, a securement for securing the at least one ramp section to the shelf said securement being a locking can which both releasably connects the at least one ramp section to the shelf and closes said inlet.

9. The quarter pipe defined in claim 8 wherein the locking cap is rotatable between locking and unlocking positions and has an outer surface which defines at least one slot for receiving a coin to facilitate turning the locking cap between said two positions.

10. The quarter pipe defined in claim 9 and further including a seal ring at the underside of the locking cap which establishes a seal around the inlet when the locking cap is in said locking position.

11. A knock-down quarter pipe comprising a horizontal base;

pairs of front and rear legs extending up from the base and for placement on a support surface below the base;

a deck supported by the legs at a selected elevation above the base, said deck having an upper surface and a front edge defining a recess thereat which extends above said pair of front legs;

a rigid grind rail seated in said recess so that the rail is substantially level with said upper surface of the deck, said rail having a pair of stubs extending down through said deck and being fastened to said pair of front legs;

a ramp having first and second ends and an upper surface extending between said ends, and connections pivotally connecting the first end of the ramp adjacent and parallel to the front edge of the deck so that the second end of the ramp is spaced in front of the base and rests on the support surface in a self-leveling fashion.

12. The quarter pipe defined in claim 11, wherein the ramp comprises two or more similar ramp sections situated side by side, the first end of each ramp section being pivotally connected to the front edge of the deck by said connections, and fasteners for fastening together adjacent ones of said ramp sections.

13. The quarter pipe defined in claim 11 wherein the base is hollow and includes an inlet for filling the base with a fluid medium, and further including a closure member for closing the inlet.

14. The quarter pipe defined in claim 11 wherein the ramp comprises an entry section having a lower end which constitutes said second end and an upper end which defines a shelf;

at least one arcuate ramp section which extends from the front edge of the deck down to said shelf, and a securement for securing the at least one ramp section to the shelf.

15. A knock-down quarter-pipe comprising a base;

a plurality of legs extending up from the base and for placement on a support surface;

a deck supported by the legs at a selected elevation above the base, said deck having an upper surface and a front edge; a ramp having first and second ends and an upper surface extending between said ends, and connecting means for pivotally connecting the first end of the ramp to the front edge of the deck so that the second end of the ramp is spaced in front of the base and may rest on the support surface in a self-leveling fashion, said connecting means including at least one notch in the front edge of the deck, a rigid cylindrical rail mounted to the front edge of deck so as to bridge said notch, and a curved tongue extending from the first end of the ramp, the curvature of the tongue corresponding to that of the rail, said tongue being dimensioned so that when the second end of the ramp is elevated with respect to the base, the tongue may be inserted into said notch from below behind the rail so that the rail functions as a pivot for the tongue and when the second end of the ramp is swung down to the level of the base, the tongue becomes pivotally locked behind the rail.

16. The quarter pipe defined in claim 15 wherein the rail extends the full width of the deck between the deck and the ramp such that the upper surfaces of the deck and ramp are substantially tangent to said rail.

17. The quarter pipe defined in claim 15 wherein the rail has two depending stubs, and at least two of said legs have upper ends releasably connected to said stubs.

18. The quarter pipe defined in claim 17 wherein the two stubs are telescopically received in the two legs, and further including locking means for releasably locking the two legs to the two stubs.

19. A knock-down quarter-pipe comprising a hollow base including an inlet for filling the base with a fluid medium;

a closure member for closing said inlet;

a plurality of legs extending up from the base and for placement on a support surface;

a deck supported by the legs at a selected elevation above the base, said deck having an upper surface and a front edge;

a ramp having first and second ends and an upper surface extending between said ends, said ramp including an entry section having a lower end which defines the second end of the ramp and an upper end which defines a shelf, at least one arcuate ramp section which extends from the front edge of the deck down to said shelf, and means for securing the at least one ramp section to the shelf, and connections for pivotally connecting the first end of the ramp to the front edge of the deck so that the second end of the ramp is spaced in from of the base and may rest on the support surface in a self-leveling fashion.

20. The quarter pipe defined in claim 19 wherein the entry section is hollow and includes an inlet at said shelf, and the securing means include a locking cap which both connects the at least one ramp section to the shelf and closes said inlet.

21. A quarter pipe for bikers, skateboarders and skaters comprising a deck having an upper surface and a front edge;

a plurality of legs, said legs having corresponding upper ends connected to the deck and corresponding lower ends lying in a common plane below the deck;

at least one notch in the front edge of the deck;

a rigid rail mounted to the front edge of the deck so as to bridge said notch;

a ramp having first and second ends and an upper surface extending between said ends, and a curved tongue extending from the first end of the ramp, said tongue being shaped and dimensioned so that when the second end of the ramp is elevated above said base, the tongue may be inserted from below into the notch behind the rail whereby when the second end of the ramp is moved down to said plane, the tongue becomes locked behind the rail.

22. The quarter pipe defined in claim 21 wherein the rail is generally cylindrical and extends the entire length of said front edge, and the upper surfaces of said deck and ramp are substantially tangent to said rail.

23. The quarter pipe defined in claim 21 and further including a base connected to said legs below said deck.

24. The quarter pipe defined in claim 23 wherein the base is hollow and includes an inlet for filling one base with a fluid medium and a closure member for said inlet.

25. The quarter pipe defined in claim 21 wherein the upper surface of the ramp defines a concave arc.

26. The quarter pipe defined in claim 25 wherein said ramp comprises an entry section having a lower end which defines said second end of the ramp and an upper end which defines a shelf;

at least one ramp section which extends from the front edge of the deck down to said shelf, and a securement for securing the at least one ramp section to the shelf.

27. The quarter pipe defined in claim 21 wherein the ramp includes first and second ramp sections situated side by side, and one or more connections between the two ramp sections.

28. A knock-down quarter-pipe for bikers, skateboarders and in-line skaters comprising a platform assembly including a pair of spaced-apart upstanding tubular front legs, a pair of spaced-apart upstanding tubular rear legs, each of said front and rear legs having a lower end for placement on a support surface and an upper end, the upper ends of the pairs of legs together defining a generally horizontal plane, a deck positioned on the upper ends of said pairs of front and rear legs, said deck having an upper surface and a front edge including a trough that extends between the pair of front legs, a rigid, generally cylindrical grind rail positioned in said trough so that said rail is substantially level with said upper surface, said rail having a pair of stubs which extend down through said deck into the upper ends of said pair of front legs, and securing devices for securing the pair of stubs in said pair of front legs, and a ramp assembly including a ramp having an upper end, a lower end and a top surface extending between said upper and lower ends, and a connection connecting said upper end to the platform assembly so that said top surface is generally tangent to said rail and said lower end is spaced in front of said front legs below said deck.

29. The quarter-pipe defined in claim 28 and further including a washer seated on the upper end of each leg under said deck, the washer on the pair of front legs receiving said stubs and the washers on the pair of rear legs receiving a pair of rear posts that extend down through the deck into the pair of rear legs, and second securing devices for securing the pair of rear posts in the pair of rear legs.

30. The quarter-pipe defined in claim 29 wherein said rear posts have upper ends connected by a hand rail spaced above the deck.

31. The quarter-pipe defined in claim 30 and further including a flexible cover member covering said hand rail and extending down over said rear posts.

32. The quarter-pipe defined in claim 28 and further including a generally horizontal base spaced below said deck and connecting said pairs of legs.

33. The quarter-pipe defined in claim 32 and further including a first mass weighting down said base.

34. The quarter-pipe defined in claim 33 and further including a second mass weighting down the lower end of the ramp.

35. The quarter-pipe defined in claim 28 wherein said ramp comprises an entry section having a front end which constitutes the lower end of the ramp and a rear end which defines a shelf;

a first ramp section which extends from said grind rail down to said shelf, said first ramp section having a lower end, and a first securement for releasably securing the lower end of said first ramp section to said shelf.

36. The quarter-pipe defined in claim 35 and further including a generally horizontal base member spaced below said deck and connecting said plurality of legs.

37. The quarter-pipe defined in claim 35 wherein said ramp also includes a second similar ramp section situated next to the first ramp section;

a second securement for releasably securing the lower end of the second ramp section to said shelf, and one or more connections connecting said first and second ramp sections along their lengths.

* * * * *